US005755084A

United States Patent [19]

Dekker

[11] Patent Number: 5,755,084

[45] Date of Patent: May 26, 1998

[54] DEVICE FOR ARRANGING A BAND OF FLEXIBLE MATERIAL ROUND AT LEAST ONE PRODUCT

[75] Inventor: Odulfus Franciscus Dekker, Heemskerk, Netherlands

[73] Assignee: Band-it Patent B.V., Woerden, Netherlands

[21] Appl. No.: 682,558

[22] PCT Filed: Jan. 24, 1995

[86] PCT No.: PCT/NL95/00035

§ 371 Date: Oct. 29, 1996

§ 102(e) Date: Oct. 29, 1996

[87] PCT Pub. No.: WO95/19913

PCT Pub. Date: Jul. 27, 1995

[30] Foreign Application Priority Data

Jan. 25, 1994 [NL] Netherlands ..... 9400112

[51] Int. Cl.[6] ..... B65B 13/04

[52] U.S. Cl. ..... 53/589; 53/589; 100/26

[58] Field of Search ..... 53/589, 389.15, 53/582; 100/25, 26, 27

[56] References Cited

U.S. PATENT DOCUMENTS

| | | | |
|---|---|---|---|
| 3,852,937 | 12/1974 | Butsura et al. | 53/389.5 |
| 4,211,349 | 7/1980 | van der Wal | 100/26 X |
| 4,578,931 | 4/1986 | Roovers | 53/389.5 |
| 5,168,686 | 12/1992 | Guttinger | 53/589 X |

FOREIGN PATENT DOCUMENTS

| | | | |
|---|---|---|---|
| 0456604 | 11/1991 | European Pat. Off. . | |
| 3637621 | 5/1988 | Germany | 53/589 |
| 3240618 | 10/1991 | Japan | 100/26 |
| 551018 | 3/1993 | Japan | 53/589 |

*Primary Examiner*—Linda Johnson
*Attorney, Agent, or Firm*—Webb Ziesenheim Bruening Logsdon Orkin & Hanson, P.C.

[57] ABSTRACT

A device for arranging a band of flexible material, in particular paper or plastic, round at least one product. The device includes a feed mechanism for feeding band material from a supply roll, an assembly for forming a loop in an end portion of the band material round a space for receiving the product, an assembly for severing that end portion and a welding assembly for closing the loop.

6 Claims, 3 Drawing Sheets

DEVICE FOR ARRANGING A BAND OF FLEXIBLE MATERIAL ROUND AT LEAST ONE PRODUCT

BACKGROUND OF THE INVENTION

1. Field of the Invention

The invention relates to a device for arranging a band of flexible material, in particular paper or plastic, round at least one product, comprising a feed mechanism for feeding band material from a roll, means for forming a loop in an end portion of the band material round a space for receiving the product, means for severing that end portion and welding means for closing the loop. Such a device is also known under the name of a banding machine.

2. Description of the Prior Art

The existing banding machines make use of the stiffness of the band material in the transport of the band round the space for receiving a product. This takes place by making a loop in the end portion of the band material with a rotatable gripper. A significant drawback to these machines is the limited size of the loop, and therefore also of the space for receiving a product. This size depends on the flexibility of the band material; the space is more limited in the case of very flexible band material than in the case of less flexible band material.

The invention has for its object a device for arranging a band of flexible material round at least one product, wherein the size of the space for receiving a product surrounded by band material is not dependent on the stiffness of the band material.

SUMMARY OF THE INVENTION

The present invention provides a device for arranging a band of flexible material in which the means for forming the loop consist of transporting means for the band material movable round the space and suction means connected to the transporting means. With this device, the size of the object for enclosing with band material no longer depends on the flexibility of the material. This enables arrangement of a band round larger objects than has been possible up to the present time or more products than has been possible up to the present time. In addition, the proposed device is more reliable in use than existing devices.

A preferred embodiment of the device includes transporting means which comprise at least one endless conveyor belt. This conveyor belt preferably has openings, which openings are connected to a suction side of a vacuum pump. Due to the pressure difference the band material will remain held against the conveyor belt whereby the band material can be carried round the product space by the endless conveyor belt.

The connection between the vacuum pump and the conveyor belt is preferably formed by an underpressure channel engaging round the conveyor belt. With this step the suction action of a single vacuum pump can be utilized over the whole length of the conveyor belt.

The device is preferably further characterized in that the mutual distance of the side walls of the underpressure channel is adjustable. This enables use of different band widths with a constant quality of guiding.

The present invention will be further elucidated with reference to the non-limitative embodiments shown in the following figures.

DESCRIPTION OF THE PREFERRED EMBODIMENT

Figure 1:
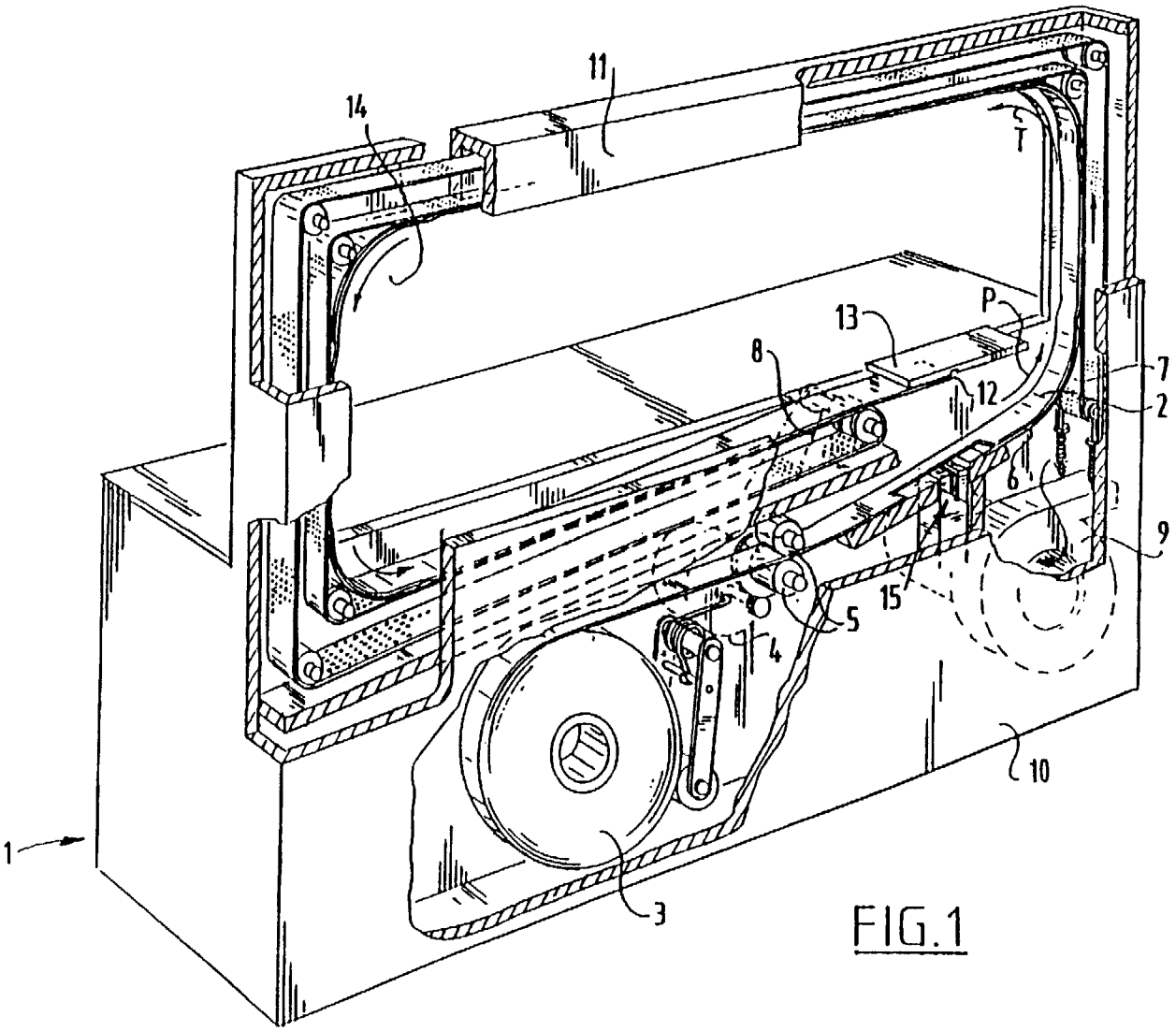
FIG. 1 shows a perspective view of a partly cut away device according to the invention.

FIG. 1 shows a device 1 with which band material 2 can be unrolled from a supply roll 3 for subsequent fastening round a product (not shown). For this purpose band material is pushed up via a guide 6 in the direction of arrow P by feed and pulling rollers 5. The band material 2 will then come into contact with a perforated endless conveyor belt 7. The conveyor belt 7 is driven by the motor 4 with interposing of a cord 8. A vacuum pump 9 pumps air out of the device 1 enclosed by a casing 10, whereby an underpressure occurs in a channel 13 engaging round the conveyor belt 7. The perforated conveyor belt 7 hereby draws in the band material 2. Conveyor belt 7 will carry along the band material 2 drawn against it in the transporting direction T. The outer end 12 of the band material 2 is subsequently clamped by a clamp 13 or by placing a product on the outer end 12. A space 14 surrounded by the band material is larger than a product placed therein. The feed and pulling rollers 5 will now tighten the band material so far that the band material fits round the product. Herein the band material 2 will thus come loose of the perforated conveyor belt 7. Finally, welding and cutting means 15 will close the loop thus arranged round the product and sever it from the remaining band material 2. The product with the loop fastened there-around can now be removed and the device 1 is ready for the following cycle.

Figure 2:
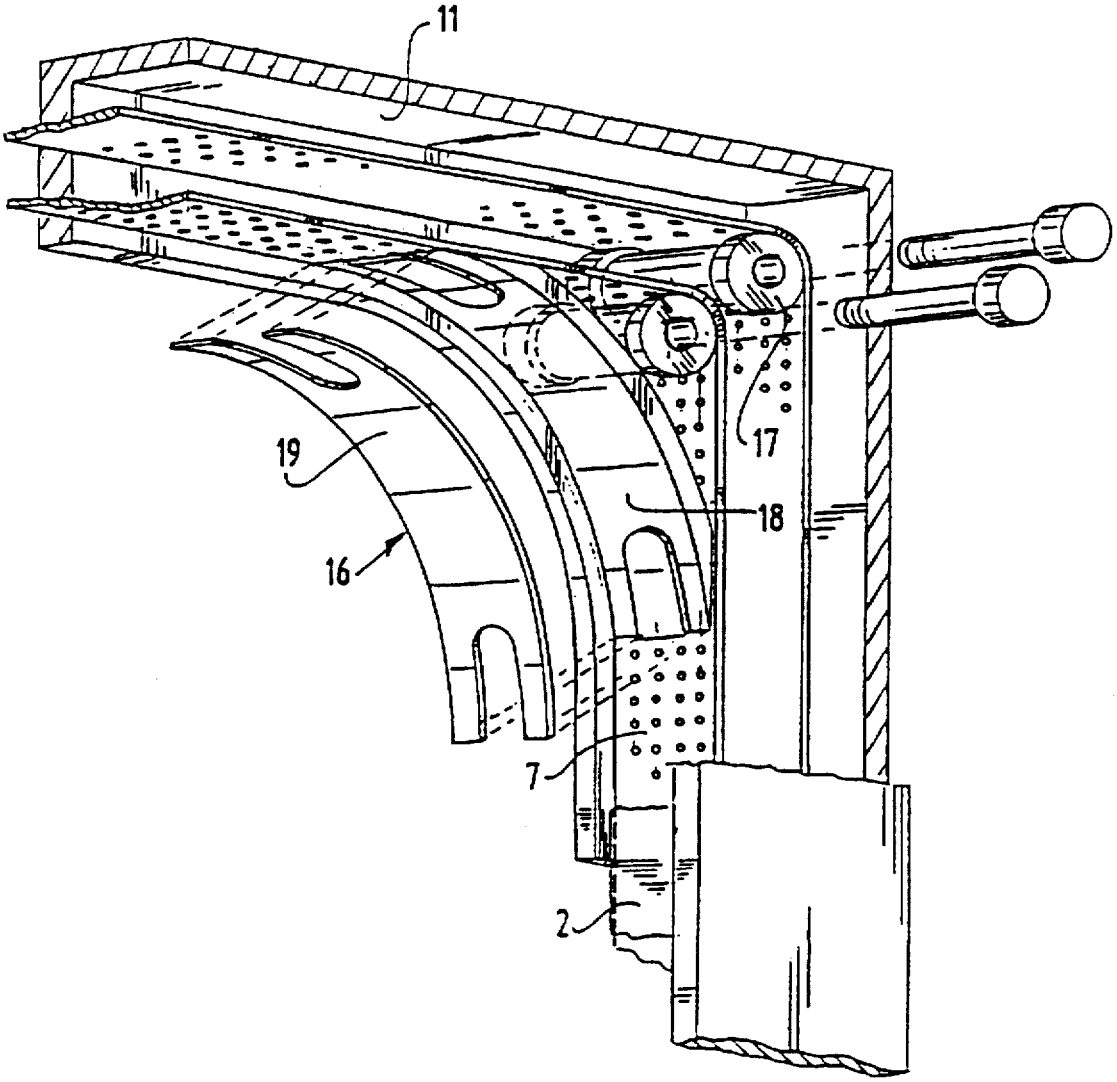
FIG. 2 shows a perspective view of a partly cut away detail of the device of FIG. 1.

FIG. 2 shows in detail a corner guide 16 for band material 2 of the device 1 of FIG. 1. The corner guide 16 is provided because a guide roller 17 of the perforated conveyor belt 7 makes it impossible for the band material 2 to lie at all points against the conveyor belt 7. The corner guide 16 comprises a holding element 18 connected to the channel 11 and a guide plate 19 for fixing on the holding element 18. It will be apparent that corner guide 16 can also be replaced by an additional conveyor belt. This has the advantage that very thin band material 2 can also be processed with the device 1.

Figure 3:
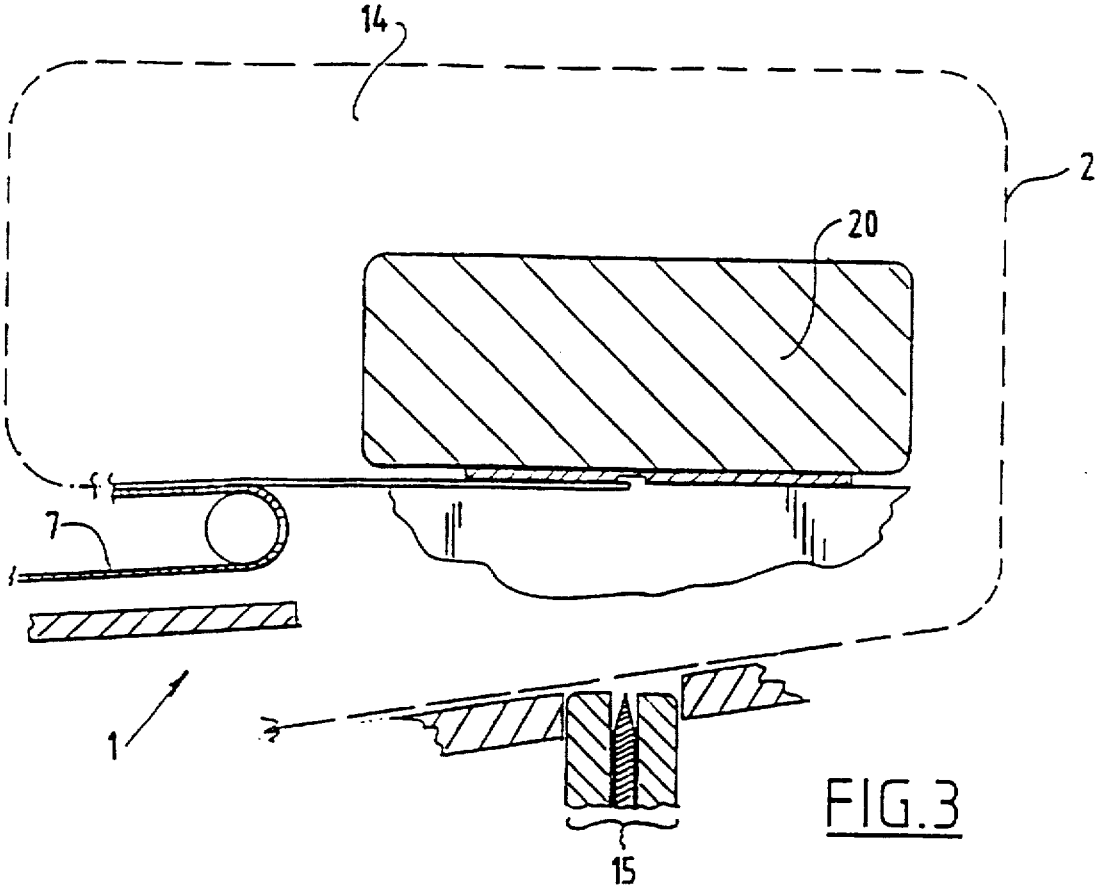
FIG. 3 is a schematic view of a part of the device of FIG. 1 with a product prior to arranging of a band.
Figure 4:
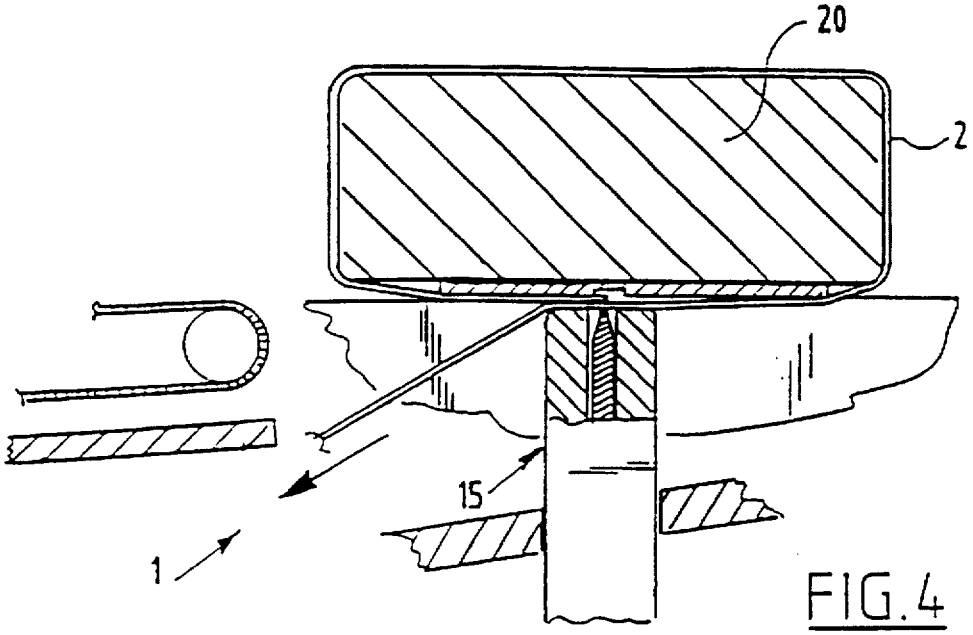
FIG. 4 is a schematic view corresponding with FIG. 3 during arranging of the band.

In the schematically depicted device 1 in FIG. 3 a product 20 is placed in the space 14 surrounded by band material 2. FIG. 4 shows a view of the schematic device 1 illustrated in FIG. 3 after the feed and pulling rollers 5 (not shown) have tightened the band material 2 round the product 20. The welding and cutting means 15 are moved to the product 20 for closing and severing the loop.

I claim:

1. A device for arranging a band of flexible material round at least one product, comprising: a supply roll; a feed mechanism for feeding band material from the supply roll; means for forming a loop in an end portion of the band material round a space for receiving the product; means for severing the end portion; and welding means for closing the loop, wherein the means for forming the loop includes transporting means for the band material movable round the space and suction means operative against the transporting means to 10 hold the band material as the band material moves round the space.

2. A device as claimed in claim 1, wherein the transporting means comprise at least one endless conveyor belt.

3. A device as claimed in claim 2, wherein the suction means includes a vacuum pump having a suction side and the conveyor belt has openings in flow 5 communication with the suction side of the vacuum pump.

4. A device as claimed in claim 3, wherein a connection between the vacuum pump and the conveyor belt is formed by an underpressure channel formed round the conveyor belt.

5. A device as claimed in claim 4, wherein the underpressure channel includes side walls and the distance between the side walls of the underpressure channel is adjustable.

6. A device as claimed in claim 2, wherein a connection between the suction means and the conveyor belt is formed by an underpressure channel formed round the conveyor belt.

* * * * *

UNITED STATES PATENT AND TRADEMARK OFFICE

CERTIFICATE OF CORRECTION

PATENT NO. : 5,755,084

DATED : May 26, 1998

INVENTOR(S) : Odulfus Franciscus Dekker

It is certified that error appears in the above-identified patent and that said Letters Patent is hereby corrected as shown below:

Column 2 Line 19 "channel 13" should read --channel 11--.

Claim 1 Column 2 Line 64 between "to" and "hold" delete --10--.

Claim 3 Column 3 Line 3 between "flow" and "communication" delete --5--.

Signed and Sealed this

Twenty-fifth Day of August, 1998

Bruce Lehman

*Attest:*

BRUCE LEHMAN

*Attesting Officer*

*Commissioner of Patents and Trademarks*